United States Patent [19]

Prasse et al.

[11] 3,947,269

[45] Mar. 30, 1976

[54] BORON-HARDENED TUNGSTEN FACING ALLOY

[75] Inventors: Herbert F. Prasse, Town and Country; Harold E. McCormick, Ballwin, both of Mo.

[73] Assignee: TRW Inc., Cleveland, Ohio

[22] Filed: Aug. 24, 1972

[21] Appl. No.: 283,330

Related U.S. Application Data

[62] Division of Ser. No. 1,187, Jan. 7, 1970, Pat. No. 3,725,017.

[52] U.S. Cl. ..... 75/170; 29/191.2; 204/164; 427/223

[51] Int. Cl.[2] ..... C22C 19/00

[58] Field of Search... 75/170, .5 AA, .5 AB, .5 BA, 75/.5 BB, 128 W, 134 N, 134 P, 134 F, 176, 171, 84; 29/191.2; 148/31.50; 23/301 SP; 204/164, 192; 117/105.2; 427/223

[56] References Cited

UNITED STATES PATENTS

| | | | |
|---|---|---|---|
| 3,096,149 | 7/1963 | Gruber | 23/301 SP |
| 3,166,833 | 1/1965 | Globus | 75/84 |
| 3,171,192 | 3/1965 | Ortner et al. | 148/31.50 |
| 3,265,494 | 8/1966 | Baldwin et al. | 75/171 |
| 3,313,633 | 4/1967 | Longo | 75/170 |
| 3,475,165 | 10/1969 | Cape | 75/171 |
| 3,698,055 | 10/1972 | Holtz et al. | 75/170 |
| 3,725,017 | 4/1973 | Prasse et al. | 29/196.6 |

FOREIGN PATENTS OR APPLICATIONS

| | | | |
|---|---|---|---|
| 1,011,635 | 12/1965 | United Kingdom | 75/170 |
| 1,813,793 | 12/1968 | Germany | 148/126 |

*Primary Examiner*—Walter R. Satterfield

[57] ABSTRACT

This invention relates to an alloy useful as a hard facing material. The alloy comprises a matrix such as a nickel-chromium matrix containing a separate interstitially boron-hardened tungsten phase. The alloy is used as a facing or coating for a number of base materials, and in particular as a piston ring facing. The invention is also concerned with a method of making said alloy by utilizing a plasma jet spray technique.

8 Claims, 16 Drawing Figures

Fig.1
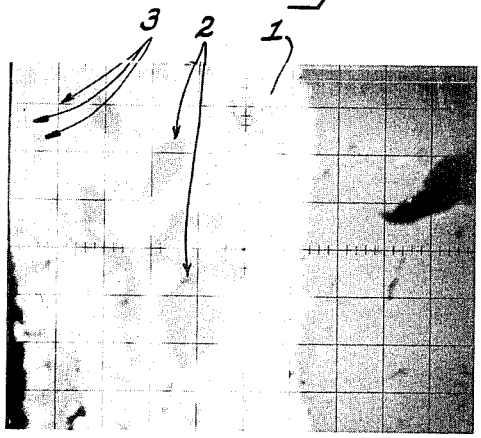
Fig.2
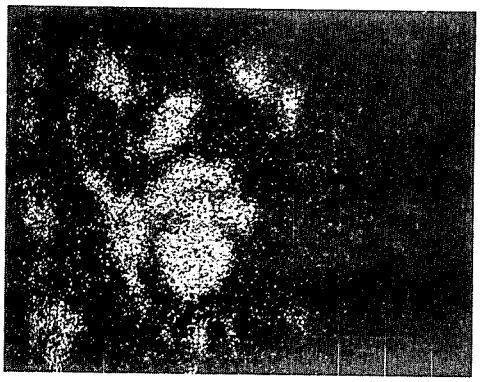
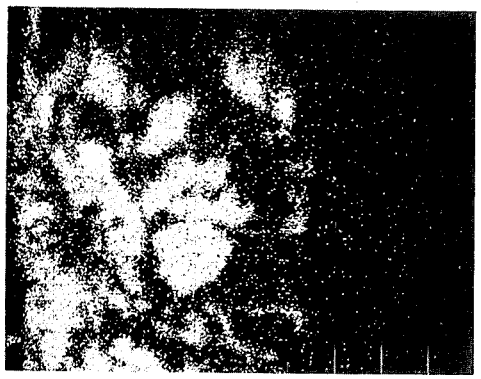
Fig.3
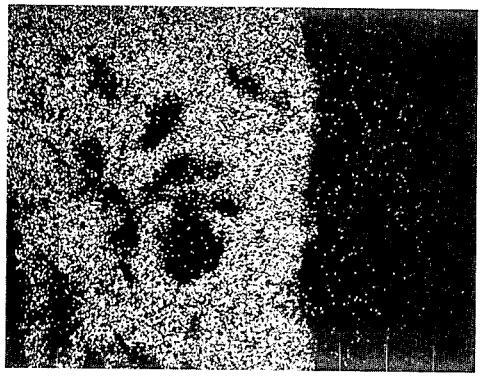
Fig.4

Fig. 5
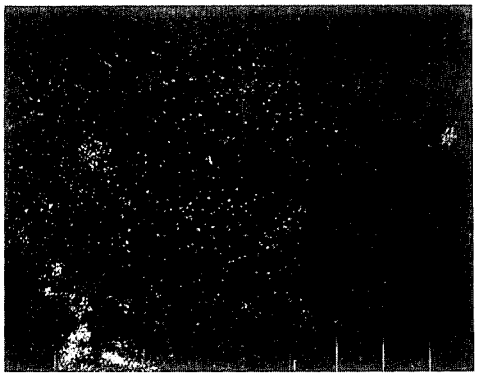
Fig. 6
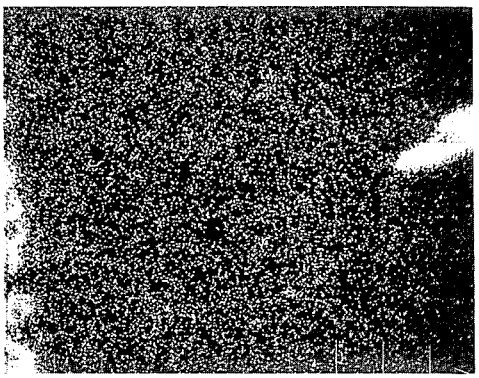
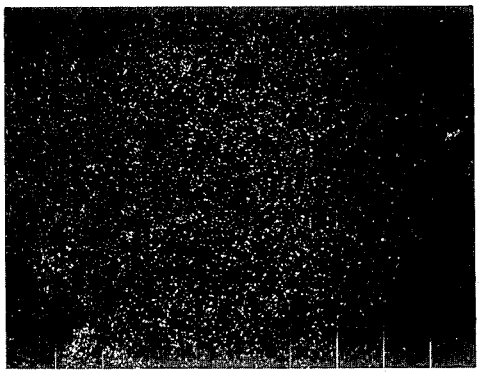
Fig. 7
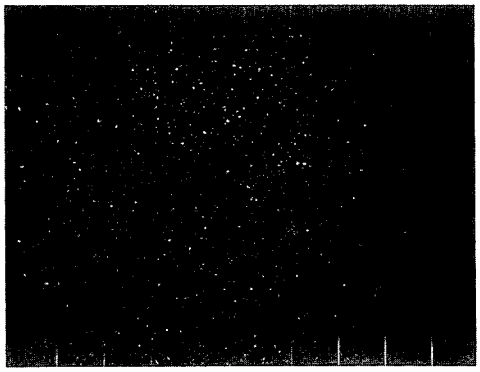
Fig. 8

Fig.9
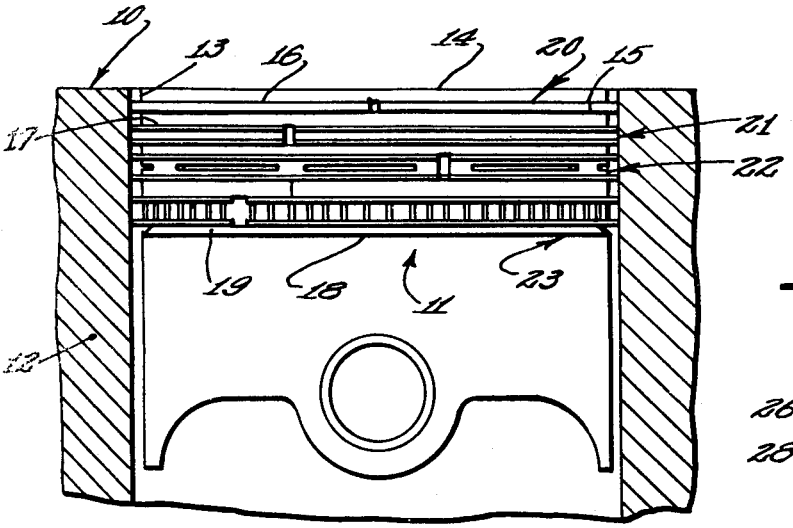
Fig.10
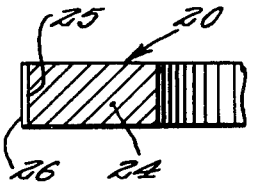
Fig.11
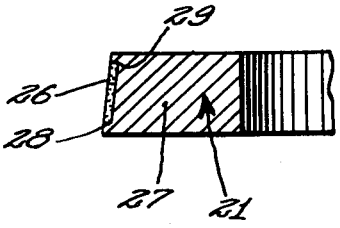
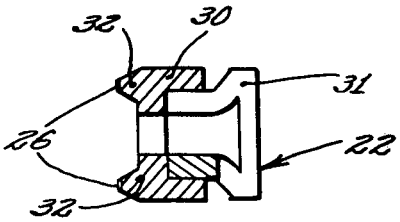
Fig.12
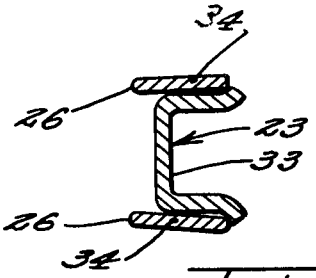
Fig.13
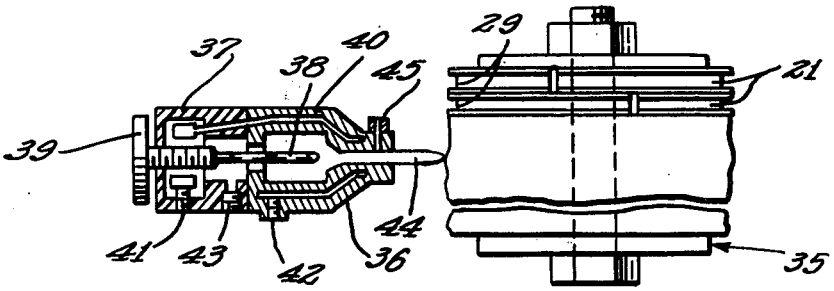
Fig.14

BORON-HARDENED TUNGSTEN FACING ALLOY

This is a division of application Ser. No. 1,187 filed Jan. 7, 1970, now U.S. Pat. No. 3,725,017.

BACKGROUND OF THE INVENTION

1. Field of the Invention

The invention is concerned with a hard facing tungsten alloy useful as a facing or coating for a wide variety of substrate materials, including iron and steel based materials. The alloy is particularly useful as a facing for piston rings, including compression and oil control rings for internal combustion engine pistons.

2. Description of the Prior Art

Piston rings, including compression rings and oil control rings are normally coated with a hard facing metal. A typical example is a flame spray applied molybdenum hard facing material which affords excellent performance for piston rings in high-compression, high temperature operating internal combustion engines. Another coating or facing for piston rings is one composed of a refractory metal carbide such as tungsten carbide. In the situation where tungsten forms the bulk of the alloy coating, to date it has been thought that the tungsten must be in the form of a compound such as tungsten carbide. Efforts to make a piston facing containing tungsten itself as a separate phase have been unsuccessful, since the tungsten has been found to be too soft, and does not protect the piston ring under typical operating conditions to the sought-after degree of performance.

It would therefore be a substantial advance in the art if an alloy were discovered which contained a substantial amount of tungsten per se as a separate phase and yet was sufficiently hard to be used as a coating for piston rings in high-compression internal combustion engines.

SUMMARY OF THE INVENTION

The present invention now provides a metal alloy useful as a hard facing which broadly comprises an alloy matrix containing a separate interstitially boron-hardened tungsten phase. The alloy matrix preferably is a nickel-chromium or nickel-aluminum matrix.

The above alloy which is particularly useful as a coating for piston rings is preferably made by a plasma jet spraying technique. Broadly speaking, the hard tungsten alloy is prepared by converting tungsten-carbide to tungsten in an oxidizing flame of a plasma arc torch and then combining the tungsten with boron to harden the tungsten phase.

A conventional plasma jet spraying operation includes the steps of providing a plasma flame spray gun containing a spray chamber to which is conveyed the plasma gas. An electric arc is applied in the chamber to ionize the gas. To the chamber there is attached a jet nozzle to which is added a spray metal powder preferably suspended in a carrier gas. The metal powder is then melted and thrust upon a base material operating as a workpiece whereby said base material is coated. The coating on the base material is built up by moving the gun relative to the workpiece or by moving the workpiece relative to the gun or both to successively deposit a plurality of thin layers of metal.

The improvement in the above method which comprises the gist of the process of the invention here includes the steps of providing a powder of tungsten carbide, boron and at least one additional alloying element. Hydrogen is utilized in combination with nitrogen or argon as a plasma gas. The hydrogen should be flowed at a rate of 20–30 standard cubic feet per hour. Another important variable which must be controlled is the distance of the gun from the workpiece. This may be varied from 3.5 inches to 6.5 inches. Under such conditions the base material is coated with a hard facing comprising the just-described alloy containing a hardened tungsten phase.

It is therefore an object of the invention to provide a new alloy composition.

A specific object of the invention is to provide a metal alloy containing a separate hard tungsten phase.

A still further object of the invention is to provide a piston ring with a hard-faced bearing surface composed of a plasma jet applied refractory alloy.

A still further object of the invention is to provide a piston ring with a hard-facing tungsten alloy which is formed in situ on the ring by a plasma jet from a powder containing the tungsten.

Still another object of this invention is to provide a method of making the above described tungsten alloy useful as a hard facing by resort to a plasma jet coating technique, wherein certain variables of this process are specifically adjusted to achieve the desired hard tungsten-faced metal alloy.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

BRIEF DESCRIPTION OF THE DRAWINGS

FIG. 1 is a photomicrograph of a specimen typifying a tungsten alloy of the invention.

FIGS. 2–8 are X-ray fluorescence photomicrographs of various components contained in a typical alloy here.

FIG. 9 is a side elevational view, with parts in cross section, of an engine piston ring cylinder assembly, wherein the piston has ring grooves equipped with compression and oil control rings, each having a bearing face engaging the cylinder which is composed of in situ formed plasma jet applied tungsten alloys, according to this invention.

FIG. 10 is an enlarged fragmentary cross-sectional view of the top compression ring in the piston of FIG. 9.

FIG. 11 is a view similar to FIG. 10, but illustrating the second compression ring in the piston of FIG. 9.

FIG. 12 is a view similar to FIG. 10, but illustrating the oil control ring in the third ring groove of the piston of FIG. 9.

FIG. 13 is a view similar to FIG. 10, but illustrating the oil control ring in the fourth ring groove of the piston of FIG. 9.

FIG. 14 is a diagrammatic cross-sectional view of a plasma flame spray gun typically used to coat a base material according to the method of the invention.

DESCRIPTION OF THE PREFERRED EMBODIMENTS

Figure 16:
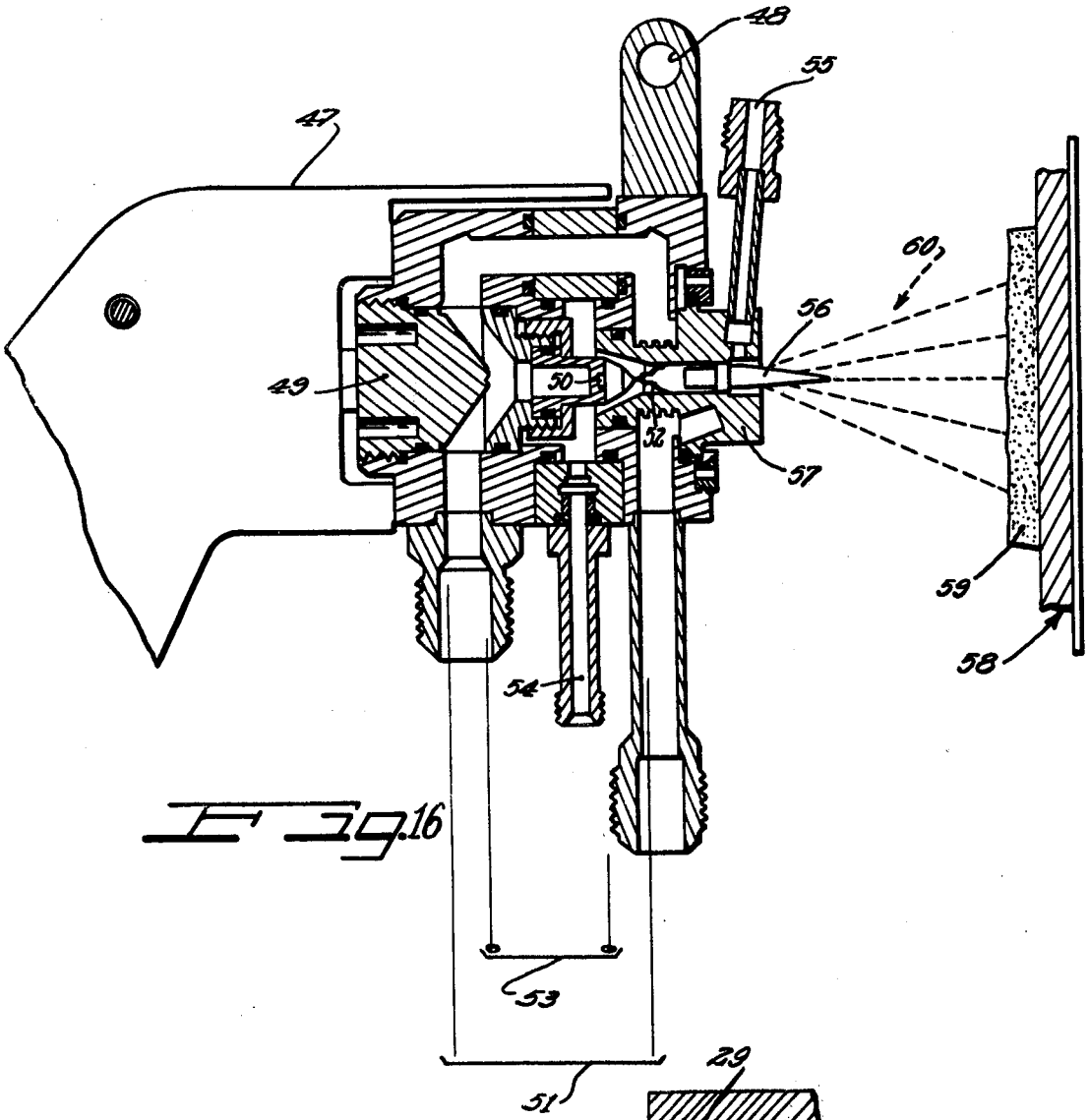
FIG. 16 is a further diagrammatic cross-sectional view of a plasma flame spray gun showing its operation in more detail.

As noted above, a novel tungsten metal alloy has been discovered here. This alloy which is particularly useful as a hard facing for piston rings comprises an alloy matrix containing a separate interstitially boron-hardened tungsten phase. This alloy is believed to be the first alloy known which contained a tungsten phase which had sufficient hardness wherein a hard facing could be prepared therefrom. For example, the alloy here has a Vickers hardness 40 DPN (diamond penetration number with a 40 gram load) of greater than about 2000. The hardness of the tungsten phase will generally range between 2500 and 3500 Vickers, and more often will fall within the range of 2700–3200 Vickers.

The alloys of the invention contain a relatively high amount of tungsten as a separate phase. Generally, the amount of tungsten is at least 35% by volume of the alloy specimen, and more often ranges from about 35% to about 60% by volume.

In greatly preferred embodiment the matrix containing the tungsten phase is a nickel-chromium matrix. In such situation there is usually present free nickel. When free nickel is present it is usually available in an amount less than about 6.0%.

The hardness of the nickel-chromium matrix phase is usually at least 800 Vickers (40DPN), more often 850–1600 Vickers, and most typically 900–1200. The free nickel phase normally thought to be relatively soft has a hardness of at least 400 Vickers (40DPN). The free nickel hardness will normally range from about 400 Vickers to about 900 Vickers. In a typical situation the free nickel hardness is 500 Vickers.

Boron, of course, is an integral part of the metal alloys of the invention, and is usually present in an amount ranging from about 1% to about 7% by weight of the facing or coating alloy, more often 1.5–5% by weight. In addition to hardening the tungsten phase the boron also hardens the free nickel phase. The interstitial hardening by boron takes place by a distending of the lattice structure of tungsten and nickel. That is, boron is substituted in the lattice parameter of tungsten whereby the tungsten phase is sufficiently hardened to be useful as a hard facing or coating.

As will be described in more detail hereinafter, it is greatly preferred that the alloy invention be derived by plasma jet spraying a powder mixture or alloy comprising at least tungsten carbide and boron and at least one additional alloying element. One typical tungsten carbide powder which can be sprayed has the following components, percentages being by weight:

| | |
|---|---|
| 25 to 55% | tungsten carbide |
| 4 to 8% | cobalt |
| 25 to 45% | nickel |
| 3 to 7% | chromium |
| 0.5 to 7% | aluminum |
| 1 to 7% | boron |
| Balance — substantially iron | |

A specific alloy contains ingredients having the following percentages by weight:

| | |
|---|---|
| 40% | tungsten carbide |
| 6% | cobalt |
| 38.8% | nickel |
| 6% | chromium |
| 1% | boron |

-continued

| | |
|---|---|
| 0.7% | aluminum |
| Balance — iron with small amounts of silicon and carbon | |

In addition to tungsten, nickel, chromium, aluminum, boron, cobalt and silicon, mentioned above, the alloys of the invention may also include a number of additional metals and metalloids such as titanium, tantalum, columbium, vanadium, zirconium, hafnium, etc.

The above-described alloys may be used to form coatings on a wide variety of conventional surfaces, as for example, on iron and steel alloys for any purpose which requires a wear and/or load-resistant surface. Thus, for example, the coatings derived from the alloys described here are extremely useful as bearing surfaces as for example, crankshafts subject to high loading forces. The coatings in accordance with the invention may also be used for forming polished rod liners, pump plungers, medium-to-high temperature-resistant steel roller bearings, furnace rolls, engine valve trim, glass molds, engine piston tops and annealing rolls or the like.

As mentioned above, the alloys are particularly useful in coating the bearing faces of piston rings. It is greatly preferred that the piston rings be coated in situ with the alloys described here by means of a plasma jet spray technique as described below.

Generally, when used to coat or face piston rings, the coating ranges in depth from about 0.002 to about 0.008 inch, and in some cases the coating depth is as high as 0.012 inch. A greatly preferred method coating base articles involves resort to a spraying technique preferably effected with a plasma flame spray gun, as for example of a type which produces a plasma flame by constricting an electric arc in a nozzle with a plasma-forming gas, for example nitrogen or argon along as a primary gas, or in mixture with hydrogen as a secondary gas. Guns which produce a plasma flame in this manner are, for example, described in U.S. Pat. No. 2,960,594. In this technique a powder is sprayed which ultimately forms the coating alloy. The term "powder" as used herein is generically intended to designate not only powder in a loose form but powder in a bonded form. Of course, in the latter situation the spray gun must utilize a flame of sufficient temperature to melt the metal. A plasma flame is extremely useful in this situation.

In more detail, the method of coating articles utilizing a plasma jet spraying technique includes the steps of conveying to a spray chamber of a plasma flame spray gun a source of a plasma gas. An electric arc is applied in said chamber to ionize said gas and a spray metal powder preferably suspended in a carrier gas is added to a jet nozzle which is connected to the chamber. The metal powder is then melted and thrust upon a base material operating as a workpiece whereby said base material is coated. The coating is specifically built up by moving the gun relative to the workpiece and workpiece relative to the gun to deposit a plurality of thin layers of metal.

It has been discovered that the above method broadly described should be carried out in a specific manner in order to deposit a tungsten phase in the coating by means of utilizing a tungsten carbide powder or alloy as a spray metal source.

The plasma flame must be an oxidizing flame at approximately 2 inches from the nozzle of the plasma gun and, preferably, contains approximately 80% by air by aspiration. The high air content and high temperature of the plasma flame is required to oxidize the tungsten-carbide particles and reduce them to tungsten according to the following reaction:

$$WC + O_2 \quad CO_2 + W + W_2C$$

The $W_2C$ may be present in very small amounts. The particle velocity at the specified gas flows and gun-to-work-distance is also very high, being in the order of 400 feet/second. The high velocity of the molten alloy gives very high quench rates when the molten alloy strikes the cooler surface to be coated. Quench rates in the order of $10^{5°}$ F per second have been estimated. The high quench rates (splat cooling) harden the normally softer nickel-aluminum or nickel-chromium alloy matrix in the final coating.

If the following directions are not carried out as indicated, there is a greater probability that a tungsten carbide phase will be formed rather than a pure tungsten metal phase.

The improvement over a conventional plasma jet spraying technique involves first providing as a powder (as powder has been broadly-defined) tungsten carbide and boron and at least one additional alloying element, such as any one or more of cobalt, nickel, chromium, aluminum, etc. Hydrogen, as a secondary gas, is utilized in combination with nitrogen or argon as a primary gas to comprise a plasma gas. It is important that the hydrogen gas flow be carried out at a rather specific rate, namely, at a flow rate of 20–30 standard cubic feet per hour, and more often 23–27 standard cubic feet per hour. In addition, it has been found that the distance of the gun from the workpiece is important in order to achieve the desired tungsten phase. Specifically, the distance may vary from about 3.5 inches to about 6.5 inches. In an average run the distance of the gun from the workpiece will be about 4 or 6 inches. Under such conditions the base material is coated with a hard facing of tungsten, and more specifically an interstitially boron-hardened tungsten phase.

A number of other process variables have been found to be important to best achieve the desired alloy coating, and particularly to deposit the desired tungsten phase in the alloy. For example, the rate of vertical traverse, governing the speed of the gas that moves across the workpiece is important. It is most desirable to match the temperature of the spray material and that of the substrate, and this is best done by properly moving the gun relative to the workpiece. This rate for best results generally ranges from about 28 inches to about 32 inches per minute.

The angle of the gun relative to the workpiece is a still further important process variation. Here, this angle should normally range from about 35° to about 55° if compression rings are being sprayed. In case of oil rings the gun angle is 0°, that is, the coating is sprayed straight on.

Other preferred expedients in carrying out the plasma spray technique include utilizing a D. C. amperage in applying said arc which ranges from about 475 amps to about 550 amps. A typical powder feed rate changes from about 10 to about 12 pounds per hour. Lastly, the flow of nitrogen or argon primary gas should range from about 80 standard cubic feet per hour to about 95 standard cubic feet per hour, and more often is 85–90 standard cubic feet per hour. Generally, the powder is conveyed to the jet by means of a carrier gas such as nitrogen. Carrier gas flow may be 45–60 standard cubic feet per hour and more often is 50–55 standard cubic feet per hour.

The thickness of the layer deposited is a matter of choice and will be dependent, of course, upon the number of passes of the gun over the base material being coated. In a typical situation involving coating of a piston ring there will be four passes involved. Generally, each pass will build up a layer having a coating thickness of 0.002 inch.

It is interesting to note here that when the spray plasma jet spray process is varied outside limits discussed above, in many instances a tungsten carbide alloy will be produced which does not contain a free tungsten phase. The directions noted above must be closely followed to provide the desired alloy containing tungsten itself as a separate phase.

In order to illustrate more fully the alloys of the invention and their mode of preparation the reader's attention is now drawn to the figures which will be described in more detail below.

FIG. 1 is a photomicrograph showing the various phase identifications made using an electron microprobe employing the specimen current images. Specifically shown is a coating containing a free tungsten metal phase 1, a nickel-chromium matrix phase 2, free nickel metal 3, and aluminum oxide 4 as major constituents. The sample was prepared by coating a piston ring according to the plasma jet spray technique outlined above. A transverse section of the coated piston ring was then used in the electron microprobe work. The samples prepared for the microprobe were rough and were therefore finish polished, using only a diamond abrasive to avoid introduction of either aluminum or chormium into the coating. The magnification in this work was 1100X.

It was noted that the tungsten phase of FIG. 1 was found to be essentially carbon free as indicated by the X-ray fluorescence photomicrograph of the carbon distribution. While it has not been completely confirmed, it is believed that the tungsten carbide in the spray powder is oxidized during the spraying to provide a free tungsten metal phase. The occurrence of oxidation was further supported by the appearance of regions of free nickel metal associated with particulate aluminum oxide, which was produced by oxidation of the nickel aluminide fraction in the original spray powder. The distribution of boron, carbon and oxygen was uniform, excluding the aluminum oxide phases.

The presence of free tungsten metal was reconfirmed by X-ray diffraction experiments which found no evidence of a WC or $W_2C$ phase in the structure, although small amounts of these constituents would not be considered detrimental in the final coating.

FIGS. 2–8 are photomicrographs of X-ray fluorescence displays of the characteristic radiation of various elements. Here, a coated piston ring was prepared by a plasma spray technique and longitudinal sections taken for use for X-ray diffraction studies. FIGS. 2–8 show X-ray fluorescence scans for the following elements respectively: chromium, nickel, tungsten, aluminum, carbon, oxygen and boron. Again the magnification was 1100X.

The piston ring sample analyzed above was designated as sample A. Three other runs were made wherein piston rings were coated utilizing a plasma gas spray procedure, following parameters carefully outlined above in order to confirm the results obtained with sample A. These samples were designated B, C and D. In each, no tungsten carbide was found either by microprobe examination or X-ray diffraction and free nickel and aluminum oxide were found in all samples.

Samples A–D were also analyzed to determine the volume fraction of the various phases present. These are given below in Table I. As is evident the free tungsten phase formed a substantial part of the alloy, and in most instances the majority of the alloy in terms of volume fraction.

TABLE 1

| Phase | VOLUME FRACTION OF VARIOUS PHASES PRESENT A | B | C | D |
|---|---|---|---|---|
| Tungsten | 57.0% | 44.0% | 50.0% | 54.6% |
| Nickel, Chromium | 39.8 | 49.7 | 48.9 | 43.6 |
| (Ni-Cr) | (32) | (38) | (44) | (34) |
| (Ni) | ( 7) | (10) | ( 5) | (10) |
| Aluminum Oxide | 1.6 | 6.2 | 1.1 | 1.8 |

Micro-hardness data was also carried out on samples A–D. A Knoop Indentor was used with a 25 gram load and the resulting impressions were measured at a magnification of 500 diameter. As is apparent from the data below in Table II, the tungsten phase was unexpectedly hard, positively evidencing interstitial hardening, since it is known that normally a tungsten phase per se is a comparatively soft material.

TABLE II

| Specimen | MICROHARDNESS DATA Knoop Hardness Numbers (KHN) Nickel-Base | Tungsten-Base |
|---|---|---|
| A | 950 to 1820 | 2700 to 3900 |
| B | 300 to 1400 | 2300 to 2500 |
| C | 500 to 1000 | 1600 |
| D | 850 to 950 | 2600 to 2800 |

While there is no direct conversion of Knoop readings to Vickers readings above about 1000, a Knoop reading of about 1800 corresponds to a Vickers reading of about 3000, showing the tungsten phase in each instance above is at least 2500 Vickers hardness.

FIGS. 9–14 depict a base material coated with the hard facing tungsten metal alloy described above.

More specifically, the piston and cylinder assembly 10 of FIG. 9 illustrates generally a conventional 4-ring groove internal combustion engine piston, operating in an engine cylinder. The assembly 10 includes a piston 11 and an engine cylinder 12 with a bore 13, receiving the piston 11. The piston 11 has a head 14 with a ring band 15 having four peripheral ring grooves 16, 17, 18 and 19 therearound. The top ring groove 16 has a split solid cast iron compression or fire piston ring 20 therein. The second ring groove 17 has a split solid second compression ring 21 somewhat wider than the ring 20. The third ring groove 18 carries a twopiece oil control ring assembly 22. The fourth or bottom ring groove 19 carries a three-piece oil control ring assembly 23.

As shown in FIG. 10, the top compression or fire ring 20 has a main body 24 composed of cast iron, preferably nodular gray iron, with a carbon content of about 3½% by weight. The outer periphery 25 of this ring is covered with a plasma jet applied alloy coating 26 of the invention.

As shown in FIG. 11, the second compression ring 21 has a main body 27 composed of the same type of cast iron as the body 24 of the ring 20. The outer periphery 28 of the body 27 is inclined upwardly and inwardly from the bottom edge of the ring and a peripheral groove 29 is formed around this inclined periphery. The groove 29 is filled with the alloy 26.

As shown in FIG. 12, the oil control ring assembly 22 in the third ring groove 18 is composed of a one-piece flexible channel ring 30 and a sheet-metal expander ring 31, having legs extending into the channel for expanding the ring 30. The ring 30 and the expander are more fully described in Mayhew et al U.S. Pat. No. 3,281,156.

The one-piece oil control ring 30 has a pair of axially spaced, radially projecting beads 32. The peripheries of these beads 32 are coated with the coating 26.

In FIG. 13, the oil control ring assembly 23 includes a resilient spacer-expander ring 33 supporting and expanding split thin rail ring 34. The assembly 33 is of the type disclosed in the Marien U.S. Pat. No. 3,133,739. The outer peripheries of the rail rings 34 are coated with the coating 26, according to this invention.

From the above description, it will be understood that the bearing faces of each of the compression and oil control rings 20, 21, 22 and 23 are coated with the alloy containing a free tungsten phase according to this invention. These bearing faces 26 ride on and sealingly engage the bore 13 of the engine cylinder 12, and the rings are compressed in the bore 13, so as to expand tightly against the bore wall, and maintain a good sealing sliding engagement therewith.

As shown in FIG. 14, the coatings 26 are applied on the rings as for example on the grooved rings 21 by stacking a plurality of the rings on an arbor 35, with the rings compressed so that their split ends will be nearly in abutment. The arbor clamping the stack of rings in their closed, contracted position, may be mounted in a lathe and the peripheries of the rings machined to form the grooves 29 therearound. The outer peripheries of the rings 21 on the arbor are then coated with the coatings 26 from a plasma jet spray gun 36. The gun 36 includes an insulated casing such as Nylon 37, from which projects a rear electrode 38, the projection of which is adjustably controlled by a screw knob 39. The front face of the casing receives a front electrode 40. The casing 37 and electrode 40 are hollow and water-jacketed so that coolant may circulate therethrough from an inlet 41 to an outer 42. Plasma jet gas is fed through an inlet 43 into the chamber provided by the casing 37 and the electrode 40 to flow around the electrode 38.

The front end of the electrode 40 provides a nozzle outlet 44 for the plasma flame and the ingredients to form the alloy of the coating 26 are fed to this nozzle through a powder inlet 45, just in advance of the discharge outlet of the nozzle.

A plasma composed of ionized gas is produced by passing the plasma gas from the inlet 42 through an electric arc established between the electrodes 38 and 40. This plasma gas is non-oxidizing and is composed of nitrogen or argon in combination with hydrogen. The plasma flame exuding from the nozzle 44 draws the alloy-forming powder therewith by aspiration and subjects the powder ingredients to such high temperatures as to cause them to alloy. The spray powder is usually suspended in a carrier gas. The jet stream carries the alloy into the bottom of the groove 29 of each piston ring and fills the groove.

The preferred powder fed to the powder inlet 45 of the gun 36 is composed of tungsten carbide, cobalt, nickel, chromium, boron and aluminum, in the proportions indicated hereinabove.

Figure 15:
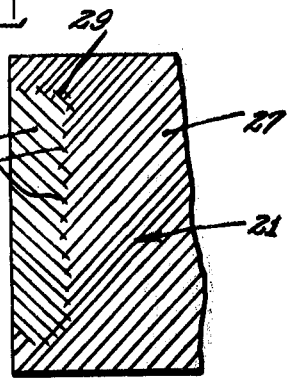
FIG. 15 shows alloy in a ring groove.

The preferred deposited coating 26 is a tungsten alloy wherein the free tungsten-boron phase is bound in a fused and alloyed matrix of the nickel and chromium. Free nickel may be present and boron acts to interstitially harden the free tungsten. The alloy 26 as illustrated in FIG. 15 is actually formed in situ in the groove 29, and is bonded to the base body 27 of the ring along a diffused interface or welded zone 46. This interface, or zone 46, is composed of the materials of the alloy 26 and the material of the ring body 27.

During the jet spray application, it is desired to maintain a temperature in the groove 29 such that will prevent excessive melting and burning away of the body metal 27 and also to act as a rapid quench to harden the nickel aluminum alloy matrix. For this end result, the arbor or rings is preferably cooled with an external blast of inert gas impinging on both sides of the jet flame. It is desired to keep temperatures of the rings 21 in the arbor around 400° F. or less. It is not necessary to provide any subsequent heat treatment for the plasma jet coated rings other than allowing the rings to air cool.

The powder fed to the inlet 45 is metered preferably with the aid of an aspiring gas, vibration, mechanical gearing, etc. All of the powder is completely melted and penetrates into the center cone of the plasma jet flame.

The provision of the alloy coatings 26 in a groove to form a band around the periphery of the piston ring 21, for example, utilizes the body metal of the ring as a land alongside of the groove to form an initial quick break-in surface for the ring, as described in the aforesaid Marien U.S. Pat. No. 3,133,739. The inclined periphery of the ring 21 may be formed by grinding or by torsional twisting of the ring in use in the ring groove, as described in the Marien patent.

The operation of plasma gas jet spraying is perhaps better illustrated by reference to FIG. 16 showing a spray gun of this type and its mode of operation. Shown is spray gun 47 which may be fixed for mounting at 48. Also shown is electrode holder 49 and electrode 50. The gun is cooled by circulated cooling coming from coolant source 51. The arc 52 is created by power source 53. Plasma gas is fed in at location 54, the gas being a combination of nitrogen or argon with hydrogen to prevent excessive oxidation. The spray powder is shown suspended in carrier gas, enters at opening 55 and is fed into the area of plasma flame 56 in the nozzle 57. The plasma flame, of course, is created by ionization and combustion of the plasma gas. Also shown in a prepared base material for workpiece 58 upon which is coated a sprayed facing material 59 by means of spray stream 60. As previously noted, the gun is moved at a transverse angle back and forth over the base material to build up a plurality of layers constituting the entire final coating.

The following Examples illustrate typical modes of carrying out the process of the invention in order to achieve the hard faced tungsten alloy containing tungsten itself as a separate alloy phase. It is understood, of course, that these Examples are merely illustrative and that the invention is not to be limited thereto.

EXAMPLE I

A powder mixture was sprayed onto an arbor of both oil rings and compression rings by the plasma jet spraying techniques described above. The powder mixture contained ingredients having the following percentages by weight:

40% tungsten carbide
6% cobalt
38.8% nickel
6% chromium
1% boron
0.7% aluminum
Balance — iron with small amounts of silicon and carbon.

The rings were coated with the hard faced tungsten coating by resort to the following specific process parameters:

| | |
|---|---|
| Gun-to-work distance | 6.0 to 6.5 inches |
| Gun angle — oil rings | 0° — (straight on) |
| Compression Rings | 45° |
| Primary gas flow ($N_2$) | 85–90 at 50 psi ref. |
| Carrier gas flow ($N_2$) | 50–55 at 50 psi |
| Secondary gas flow ($H_2$) | 23–27 at 50 psi ref. |
| D.C. current | 500–525 amps. |
| D.C. voltage | 80–86 volts ref. |
| Powder feed rate | 10.5 lbs./hr. |
| Vertical feed rate | 28–32 in./min. |
| Arbor rotation speed | 60–90 rpm (4" dia.) |

The hard tungsten facing was then tested for hardness and had a Vickers Hardness number with respect to the tungsten phase of an average of 2,836 and a corresponding Knoop hardness of 1,781.

This particular coating was also analyzed by means of the photomicrograph techniques described with respect to FIGS. 1–8. This analysis shows that the tungsten phase was essentially carbon-free and existed as a free phase contained in a hard nickel-chromium matrix phase. Free nickel metal and aluminum oxide were the other minor constituents.

EXAMPLE II

The powder of Example I was again plasma jet sprayed but via slightly different process conditions as set out below:

PROCESS PARAMETERS

| | |
|---|---|
| Gun-to-work distance | 3¾" to 4¼" |
| Gun angle - Oil rings | 0° |
| Compression rings | 45° |
| Primary gas flow ($N_2$) | 86–88 at 50 psi |
| Carrier gas flow ($N_2$) | 52–55 at 50 psi |
| Secondary gas flow ($H_2$) | 23–27 at 50 psi |
| D.C. current | 475–500 amps. |
| D.C. voltage | 90 ref. |
| Powder feed rate | 10.5 lbs./hr. |
| Arbor rotation rpm | 90–120 (4" dia.) |

Again, the hard tungsten facing had a Vickers Hardness number above 2500 with respect to the tungsten phase, and photomicrographs demonstrated the presence of a free tungsten metal phase. A hard nickel-chromium matrix phase was also present along with free nickel metal and aluminum oxide as other minor components of the alloy coating.

In addition to nickel-chromium and nickel-aluminum, other alloys may be used as a matrix material such as nickel-iron, nickel-copper-molybdenum and monel alloys.

I claim as my invention:

1. A plasma jet sprayed metal alloy derived from a powder mixture containing nickel, chromium, boron and tungsten carbide, said alloy as a result of the plasma spraying evidencing a tungsten phase having a Vickers hardness in excess of 2,000 and a nickel chromium matrix having a Vickers hardness of at least 800, the volume fraction of said tungsten phase being at least 35%, said tungsten phase being interstitially hardened by the presence of said boron, and said alloy being substantially free from tungsten carbide.

2. The alloy of claim 1 in which said tungsten phase has a Vickers hardness of between 2,500 and 3,500.

3. The alloy of claim 1 in which said tungsten phase has a Vickers hardness of between 2,700 and 3,200.

4. The alloy of claim 1 in which said nickel-chromium matrix has a Vickers hardness of from 850 to 1,600.

5. The alloy of claim 1 in which said nickel-chromium matrix has a Vickers hardness of from 900 to 1,200.

6. The alloy of claim 1 in which the volume fraction of the tungsten phase is from 35 to 60%.

7. The alloy of claim 1 in which said powder mixture contains from 1 to 7% by weight boron.

8. The alloy of claim 1 in which said powder mixture consists essentially of:

| | |
|---|---|
| 25–55% | tungsten carbide |
| 4–8% | cobalt |
| 25–45% | nickel |
| 3–7% | chromium |
| 0.5–7% | aluminum |
| 1–7% | boron |

Balance — substantially iron.

* * * * *

UNITED STATES PATENT OFFICE

CERTIFICATE OF CORRECTION

Patent No. 3,947,269 Dated January 24, 1976

Inventor(s) Herbert F. Prasse and Harold E. McCormick

It is certified that error appears in the above-identified patent and that said Letters Patent are hereby corrected as shown below:

In item [73] of the title page, please change Assignee from "TRW Inc., Cleveland, Ohio" to --Ramsey Corporation, St. Louis, Mo.--.

Signed and Sealed this

Twentieth Day of July 1976

[SEAL]

*Attest:*

RUTH C. MASON
*Attesting Officer*

C. MARSHALL DANN
*Commissioner of Patents and Trademarks*